US010935218B2

(12) United States Patent
Zhou et al.

(10) Patent No.: US 10,935,218 B2
(45) Date of Patent: Mar. 2, 2021

(54) INSTALLATION ASSEMBLY OF CEILING LIGHTING FIXTURE, CEILING LIGHTING FIXTURE AND CEILING LAMP

(71) Applicant: OPPLE LIGHTING CO., LTD., Shanghai (CN)

(72) Inventors: Dingde Zhou, Shanghai (CN); Jianguo Li, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/863,870

(22) Filed: Apr. 30, 2020

(65) Prior Publication Data

US 2020/0256546 A1 Aug. 13, 2020

Related U.S. Application Data

(63) Continuation of application No. PCT/CN2018/110861, filed on Oct. 18, 2018.

(30) Foreign Application Priority Data

Oct. 30, 2017 (CN) ..... 201711037812.3
Oct. 30, 2017 (CN) ..... 201721416432.6

(51) Int. Cl.
*F21V 21/00* (2006.01)
*F21V 21/03* (2006.01)
(Continued)

(52) U.S. Cl.
CPC ..... *F21V 21/03* (2013.01); *F21V 3/00* (2013.01); *F21V 7/06* (2013.01); *F21V 17/162* (2013.01);
(Continued)

(58) Field of Classification Search
CPC ..... F21V 17/06; F21V 17/162; F21V 17/164; F21V 17/166; F21V 17/18; F21V 17/20; F21V 21/03; F21V 21/13; F21V 23/06
(Continued)

(56) References Cited

U.S. PATENT DOCUMENTS 6,181,251 B1 * 1/2001 Kelly ..... G08B 7/062 340/628
8,657,474 B2 * 2/2014 Breen, IV ..... H01R 33/46 362/368
(Continued)

FOREIGN PATENT DOCUMENTS

CN 102853325 A 1/2013
CN 204114761 U 1/2015
(Continued)

OTHER PUBLICATIONS

International Search Report to PCT Application No. PCT/CN2018/110861, dated Jan. 18, 2019 with English translation, (5p).

*Primary Examiner* — Laura K Tso
(74) *Attorney, Agent, or Firm* — Arch & Lake LLP

(57) ABSTRACT

An installation assembly of a ceiling lighting fixture, a ceiling lighting fixture and a ceiling lamp are provided. The installation assembly includes a fixing base and a connecting base detachably connected with the fixing base. One of the fixing base and the connecting base is provided with a snap recess, and the other of the fixing base and the connecting base is provided with an elastic buckle which is capable of being snap-fitted with the snap recess. The elastic buckle has a guide slope, the elastic buckle is capable of being compressed as the connecting base moves toward the fixing base, and being introduced into the snap recess through the guide slope. The elastic buckle is rotationally fitted with the snap
(Continued)

recess, and the snap recess is provided with an avoidance notch for the elastic buckle to be detached.

20 Claims, 6 Drawing Sheets

(51) Int. Cl.

| | |
|---|---|
| ***F21V 3/00*** | (2015.01) |
| ***F21V 23/06*** | (2006.01) |
| ***F21V 17/18*** | (2006.01) |
| ***F21V 17/16*** | (2006.01) |
| ***F21V 17/20*** | (2006.01) |
| ***F21V 7/06*** | (2006.01) |

(52) U.S. Cl.
CPC ..... *F21V 17/166* (2013.01); *F21V 17/18* (2013.01); *F21V 17/20* (2013.01); *F21V 23/06* (2013.01)

(58) Field of Classification Search
USPC ..... 362/147, 368, 649, 655, 657, 658, 659
See application file for complete search history.

(56) References Cited

U.S. PATENT DOCUMENTS

| | | | | |
|---|---|---|---|---|
| 8,684,569 | B2 * | 4/2014 | Pickard | F21V 13/14 362/382 |
| 10,107,482 | B1 * | 10/2018 | Hill | F21V 21/03 |
| 10,168,029 | B1 * | 1/2019 | Hsu | F21V 17/18 |
| 2014/0268825 | A1 * | 9/2014 | Lay | F21V 21/03 362/371 |
| 2016/0161096 | A1 * | 6/2016 | Boulanger | F21V 21/14 362/368 |

FOREIGN PATENT DOCUMENTS

| | | | | |
|---|---|---|---|---|
| CN | 105351890 | A | 2/2016 | |
| CN | 106151992 | A | 11/2016 | |
| CN | 106989328 | A | 7/2017 | |
| CN | 107606547 | A | 1/2018 | |
| CN | 207599507 | U | 7/2018 | |
| DE | 2929190 | A1 * | 1/1981 | F21V 17/14 |
| WO | WO-2016082299 | A1 * | 6/2016 | F21V 21/03 |

* cited by examiner

INSTALLATION ASSEMBLY OF CEILING LIGHTING FIXTURE, CEILING LIGHTING FIXTURE AND CEILING LAMP

CROSS-REFERENCE TO RELATED APPLICATIONS

This application is based upon and claims priority to PCT patent application No. PCT/CN2018/110861 filed on Oct. 18, 2018 which claims the priority of Chinese Patent Application No. 201711037812.3, filed on Oct. 30, 2017, and Chinese Patent Application No. 201721416432.6, filed on Oct. 30, 2017, the entire contents of which are incorporated herein by reference.

TECHNICAL FIELD

The present disclosure relates to the technical field of lighting fixture design, and more particularly, to an installation assembly of a ceiling lighting fixture, a ceiling lighting fixture and a ceiling lamp.

BACKGROUND

Ceiling lighting fixtures are lighting fixtures usually mounted on indoor roofs. A ceiling lighting fixture usually comprises a ceiling lamp and a fixing base. During a mounting process, a user needs to firstly fix the fixing base on the indoor roof, and then mount the ceiling lamp onto the fixing base. Since a gap between the ceiling lamp and the indoor roof is relatively narrow after mounting is completed, the ceiling lighting fixture has advantages such as compact mounting and beautiful appearance, and thus is widely favored by users.

The ceiling lamp includes a connecting base, and the connecting base cooperates with the fixing base to implement the mounting of the ceiling lamp, and meanwhile supplies power to a light source of the ceiling lamp. The fixing base is directly fixed on the indoor roof and is connected with a power line. The connecting base is configured to mount the light source, and the connecting base is detachably and electrically connected with the fixing base. The connecting base may be detached from the fixing base to facilitate the user to perform a wiring operation on the fixing base; and after wiring is completed, the user mounts the connecting base on the fixing base again. At present, the connecting base is usually mounted on the fixing base by screws and manual buckles, the connecting base usually requires operations by two or more persons to implement mounting and detaching, and obviously, such a connection mode renders a problem of cumbersome operations in the processes of mounting and detaching the connecting base.

SUMMARY

The present disclosure provides an installation assembly of a ceiling lighting fixture, to solve the problem of cumbersome assembling and disassembling processes of the connecting base and the fixing base.

In order to solve the above-described problem, the present disclosure adopts technical solutions below:

In a first aspect, an installation assembly of a ceiling lighting fixture is provided. The installation assembly includes a fixing base and a connecting base detachably connected with the fixing base. One of the fixing base and the connecting base is provided with a snap recess, and a remaining one of the fixing base and the connecting base is provided with an elastic buckle which is capable of being snap-fitted with the snap recess. The elastic buckle has a guide slope, the elastic buckle is capable of being compressed as the connecting base moves toward the fixing base, and being introduced into the snap recess through the guide slope. The elastic buckle is rotationally fitted with the snap recess, and the snap recess is provided with an avoidance notch for the elastic buckle to be detached.

In a second aspect, a ceiling lighting fixture is provided, where the ceiling lighting fixture includes the above-mentioned installation assembly.

In a third aspect, a ceiling lamp is provided, which includes a base plate, a light source, a driver, a connecting base, and a lamp cover assembled on the base plate; the lamp cover and the base plate forming a light mixing cavity. The light source includes a substrate and a light source; the driver and the light source being mounted on the substrate and located in the light mixing cavity. The connecting base includes a lamp body mounting portion and a side wall extending along an outer peripheral edge of the lamp body mounting portion and perpendicular to the outer peripheral edge of the lamp body mounting portion; an edge of the side wall protruding inwardly to form a flange. The flange and the side wall forming a snap recess. The snap recess is configured to be snap-fitted with an elastic buckle of a fixing base of a ceiling lighting fixture. The lamp body mounting portion includes a second electrical connection portion and an electrical connection port electrically connected with the second electrical connection portion. The driver and the light source are electrically connected with the electrical connection port. The second electrical connection portion is configured to be electrically connected with a first electrical connection portion of the fixing base.

BRIEF DESCRIPTION OF THE DRAWINGS

The drawings illustrated herein are provided for further understanding the present disclosure and constitute a part of the present disclosure, and the exemplary embodiments of the present disclosure and description thereof are used for explaining the present disclosure, rather than improperly limiting the present disclosure. In the drawings.

DETAILED DESCRIPTION

Figure 1:
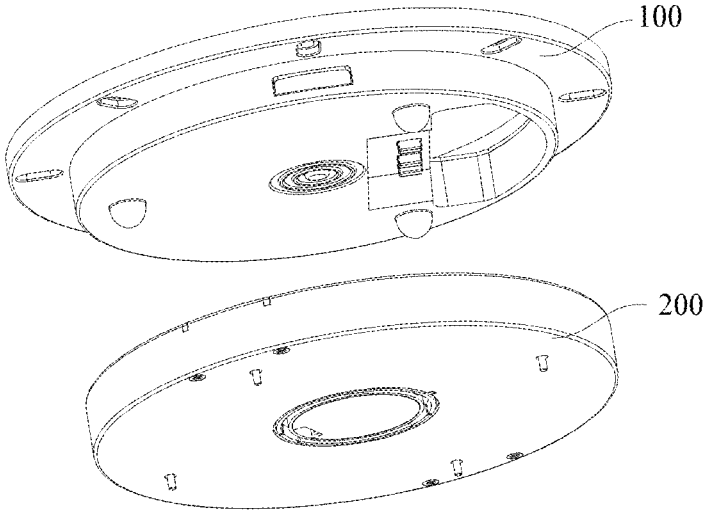
FIG. 1 is a schematic structural diagram of a fixing base and a connecting base in an unassembled state from a first viewing angle disclosed by an example of the present disclosure.

In order to make objects, technical details and advantages of the present disclosure apparent, the technical solutions of the present disclosure will be described in a clearly and fully understandable way in connection with the specific embodiments of the present disclosure and the corresponding drawings. It is obvious that the described embodiments are just a part but not all of the embodiments of the present disclosure. Based on the embodiments described herein, those ordinarily skilled in the art can obtain other embodiment(s), without any inventive work, which should be within the scope of the present disclosure.

Hereinafter, the technical solutions provided by the embodiments of the present disclosure will be described in detail in conjunction with the accompanying drawings.

Following reference numerals are used in the drawings. 100-fixing base, 110-elastic buckle, 111-guide slope, 112-buckle body, 113-first elastic member, 120-first slide hole, 130-foundation connection portion, 131-connection hole, 132-avoidance recess, 140-connecting base connection portion, 150-first electrical connection portion, 151-first annular electrical connection groove, 152-second annular electrical connection groove, 153-third annular electrical connection groove, 160-power access port, 161-positive access port, 162-negative access port, 163-ground access port, 170-control switch group, 171-first control switch, 172-second control switch, 173-third control switch, 180-threading hole, 190-elastic tensioning portion, 191-second elastic member, 192-tensioning block, 1100-second slide hole, 200-connecting base, 210-snap recess, 211-avoidance notch, 220-second electrical connection portion, 221-first annular conductive terminal, 222-second annular conductive terminal, 223-third annular conductive terminal, 230-lamp body mounting portion, 231-plate-like base body, 232-electrical connection port, 240-threaded connecting member, 250-side wall, 251-flange, 260-combining portion, 261-guide slope, 262-main body portion, 300-base plate, 400-driver, 500-lamp cover, 600-light source, 610-substrate, 620-light source.

The above-described at least one technical solution adopted in the present disclosure may achieve beneficial effects below. In the installation assembly disclosed in the present disclosure, the user only needs to hold the connecting base and press the same to the fixing base, so as to implement assembling of the connecting base and the fixing base; and the user just holds the connecting base and rotates the same relative to the fixing base, so as to implement disassembling. The mounting and detaching operations of the installation assembly are relatively simple and convenient. As compared with the current threaded connection and manually-operated buckle between the connecting base and the fixing base, the installation assembly disclosed in the present disclosure requires fewer operations to implement assembling and disassembling of the connecting base and the fixing base, which may further solve the problem of cumbersome assembling and disassembling of the connecting base and the fixing base.

Referring to FIG. 1 to FIG. 11, an example of the present disclosure discloses an installation assembly of a ceiling lighting fixture, and the disclosed installation assembly comprises a fixing base 100 and a connecting base 200. The fixing base 100 is configured to be fixed on a mounting foundation (e.g., an indoor roof), and meanwhile be connected with a power line. The connecting base 200 is detachably connected with the fixing base 100; the so-called detachable connection refers to that the connecting base 200 may be mounted on the fixing base 100, or may be detached from the fixing base 100. The fixing base 100 is an assembling foundation for the connecting base 200; the connecting base 200 is configured to be electrically connected with a light source 600 of the ceiling lighting fixture; and a circuit connection between the connecting base 200 and the fixing base 100 may be implemented by mounting the connecting base 200 onto the fixing base 100, to further implement supplying power to the light source 600 through the power line.

In the example of the present disclosure, one of the fixing base 100 and the connecting base 200 is provided with a snap recess, and the other is provided with an elastic buckle; snap-fitting between the snap recess and the elastic buckle may implement assembling between the connecting base 200 and fixing base 100. Hereinafter, it will be described in detail by taking the case that the fixing base 100 is provided with an elastic buckle 110 and the connecting base 200 is provided with a snap recess 210 as an example.

The elastic buckle 110 has a guide slope 111; the elastic buckle 110 has elasticity, which may be compressed under an action of an external force, and elastically recover after the external force is withdrawn. The elastic buckle 110 may be compressed as the connecting base 200 moves toward the fixing base 100 and be guided into the snap recess 210 through the guide slope 111. A specific process is as follows: the connecting base 200 moves toward the fixing base 100, the guide slope 111 contacts the connecting base 200, and as the connecting base 200 moves forward continuously, the guide slope 111 moves relative to the connecting base 200, so that the elastic buckle 110 is compressed and achieves a purpose of avoiding the connecting base 200. As the connecting base 200 moves forward continuously, the snap recess 210 will move to a position opposite to the elastic buckle 110, the snap recess 210 allows the pressure exerted by the connecting base 200 on the guide slope 111 to withdraw, to further make the elastic buckle 110 to recover and finally extend into the snap recess 210, so that the elastic buckle 110 is snap-fitted with the snap recess 210.

The elastic buckle 110 is rotationally fitted with the snap recess 210, and may further make the connecting base 200 to rotate relative to the fixing base 100. The snap recess 210 is provided with an avoidance notch 211 for the elastic buckle 110 to break away, that is, when the elastic buckle 110 rotates to the avoidance notch 211, it may break away from the snap recess 210, to achieve the purpose of detaching the connecting base 200.

Certainly, when the elastic buckle 110 is provided on the connecting base 200, and accordingly, the snap recess 210 is provided on the fixing base 100, the above-described fit process still works, which will not be repeated herein.

The mounting and detaching processes of the installation assembly of the ceiling lighting fixture disclosed by the embodiments of the present disclosure are as follows:

During the mounting process, a user firstly fixes the fixing base 100 onto the mounting foundation, then couples the power line to the fixing base 100, and then holds the connecting base 200 and presses the connecting base 200 toward the fixing base 100; as the connecting base 200 moves toward the fixing base 100, the elastic buckle 110 is compressed by the guide slope 111; as the connecting base 200 moves continuously, the elastic buckle 110 will eventually extend into the snap recess 210 under an action of an elastic restoring force, and finally get snap-fitted with the snap recess 210, thereby implementing assembling of the installation assembly.

During the detaching process, the user only needs to manipulate the connecting base 200 to rotate relative to the fixing base 100; as the connecting base 200 rotates relative to the fixing base 100, the elastic buckle 110 may be located at a position corresponding to the avoidance notch 211, so that the connecting base 200 falls off, thereby finally completing disassembling of the connecting base 200.

According to the above-described working process, it can be known that, by means of the installation assembly disclosed by the example of the present disclosure, the user only needs to hold the connecting base 200 and press the connecting base 200 toward the fixing base 100, so as to implement assembling between the connecting base 200 and the fixing base 100; and during detaching, the user may hold the connecting base 200 and rotate the connecting base 200 relative to the fixing base 100, so as to implement disassembling. As compared with the current threaded connection or the manually-operated buckle between the connecting base and the fixing base, the installation assembly disclosed by the example of the present disclosure requires fewer operations to implement assembling and disassembling of the connecting base 200 and the fixing base 100, which may further solve the problem of cumbersome assembling and disassembling between the connecting base and the fixing base.

In the example of the present disclosure, the number of elastic buckles 110 may be one or plural. In a case of one elastic buckle 110, auxiliary connection structures such as snap pieces and hooks may be provided on the fixing base 100 or the connecting base 200; during mounting, the user may firstly dock a portion of the connecting base 200 into place, and then press the connecting base 200 to make it move toward the fixing base 100, so that the elastic buckle 110 is finally snapped into the snap recess 210. Alternatively or additionally, there are a plurality of elastic buckles 110, and in this case, the user only needs to evenly press the connecting base 200 in a direction perpendicular to the mounting foundation (e.g., the indoor roof) so as to implement assembling.

Figure 6:
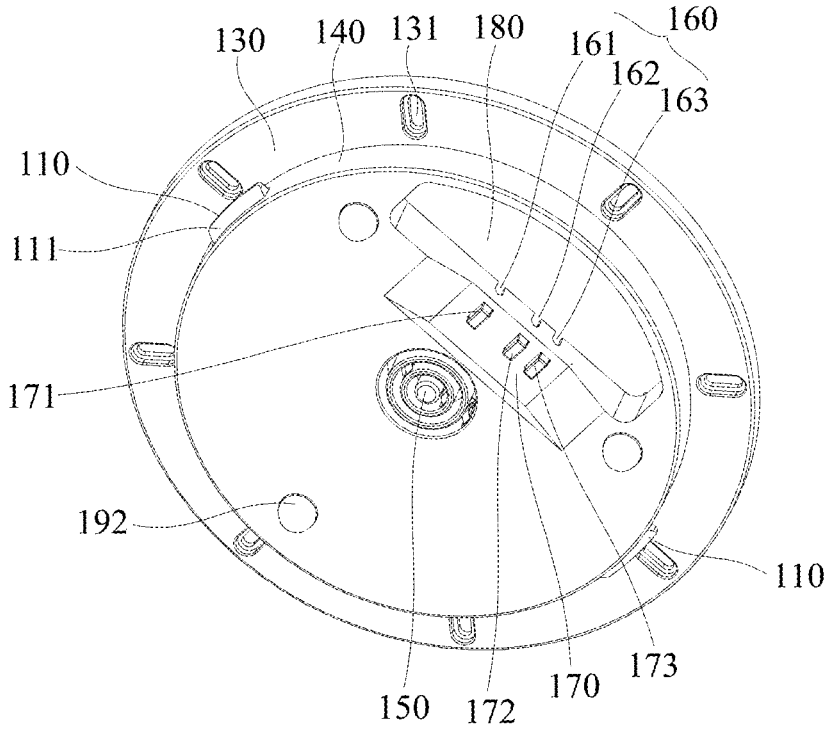
FIG. 6 is a schematic structural diagram of the fixing base from a viewing angle disclosed by an example of the present disclosure.

In the example of the present disclosure, the elastic buckle 110 has a variety of structures as long as the elastic buckle 110 may be ensured to be snap-fitted with the snap recess 210, and meanwhile, the elastic buckle 110 has a structural member with a certain telescopic function. In a specific implementation, the elastic buckle 110 may include a buckle body 112 and a first elastic member 113. The first elastic member 113 has one end provided on the fixing base 100 or the connecting base 200, and the other end connected with the buckle body 112; and the buckle body 112 has a guide slope 111. The buckle body 112 is a portion of the elastic buckle 110 which may be snap-fitted with the snap recess 210, and the first elastic member 113 is a component that realize extension and retraction of the buckle body 112. After the guide slope 111 on the buckle body 112 is pressed, the buckle body 112 compresses the first elastic member 113, so that the elastic buckle 110 is finally compressed. Specifically, the first elastic member 113 may be a highly elastic member such as a spring or an elastic rubber block. Specifically, there are two elastic buckles 110, and the two elastic buckles 110 are symmetrically arranged on the fixing base 100 or the connecting base 200, as shown in FIG. 6.

In order to make extension and retraction of the elastic buckle 110 more stable to further ensure accurate fit between the elastic buckle 110 and the snap recess 210, in a preferred solution, the fixing base 100 is provided with a first slide hole 120, and the elastic buckle 110 is slidably provided in the first slide hole 120. In this case, the elastic buckle 110 may move telescopically as guided by the first slide hole 120, so that movement accuracy may be further improved. In the case where the elastic buckle 110 includes the buckle body 112 and the first elastic member 113, the first elastic member 113 is provided in the first slide hole 120, the buckle body 112 is slidably provided in the first slide hole 120, and one end of the buckle body 112 that is provided with the guide slope 111 extends out from the first slide hole 120. Certainly, if the elastic buckle 110 is provided on the connecting base 200, the first slide hole 120 is provided on the connecting base 200.

Figure 2:
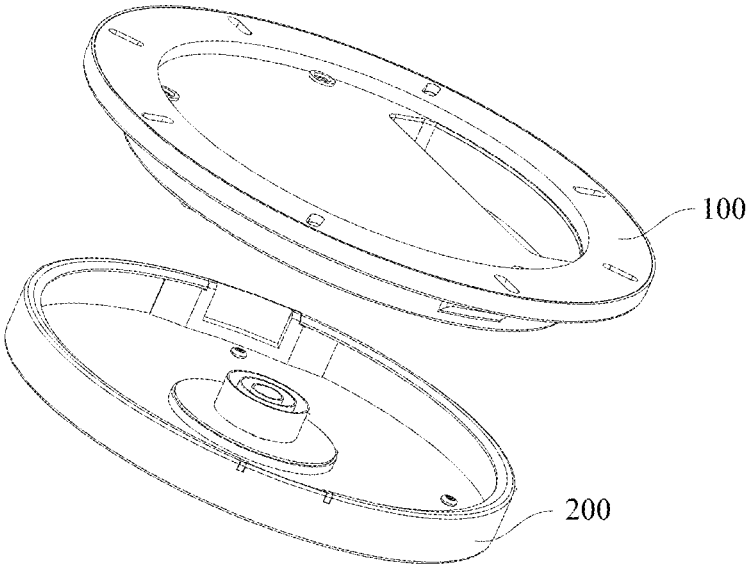
FIG. 2 is a schematic structural diagram of the fixing base and the connecting base in the unassembled state from another viewing angle disclosed by the example of the present disclosure.
Figure 3:
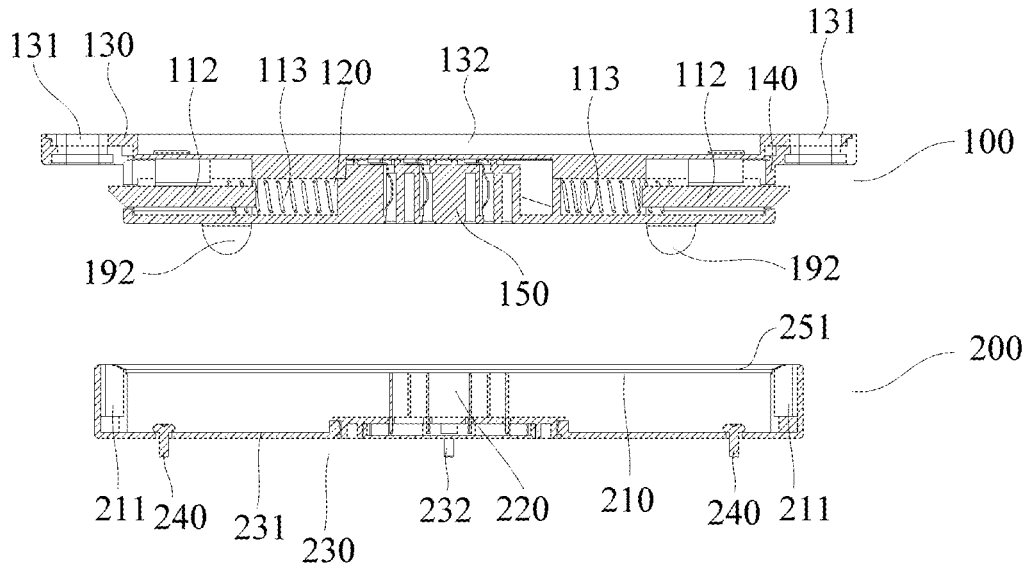
FIG. 3 illustrates a cross-sectional view of the fixing base in the unassembled state disclosed by an example of the present disclosure.

In the example of the present disclosure, the connecting base 200 and the fixing base 100 usually have disc-shaped structures, as shown in FIG. 1 and FIG. 2, the first slide hole 120 may extend along a radial direction of the fixing base 100 or the connecting base 200, as shown in FIG. 3.

Referring to FIG. 3, FIG. 6, FIG. 7, FIG. 8 or FIG. 9 again, in a specific implementation, the fixing base 100 is provided with the elastic buckle 110, the connecting base 200 has a cover-like structure, and the snap recess 210 is provided on an inner wall of the connecting base 200. The snap recess 210 may be implemented by a groove structure formed by inward folding of a top opening edge of the cover-like structure. In a preferred solution, an inner wall of the avoidance notch 211 protrudes out from an inner wall corresponding to the snap recess 210, and a guide transition surface is provided between the inner wall of the avoidance notch 211 and the inner wall corresponding to the snap recess 210; during the process when the user rotates the connecting base 200, the guide transition surface guides the elastic buckle 110 to be gradually compressed, and further to extend into the avoidance notch 211 under an action of an elastic restoring force, so as to implement detachment. The guide transition surface is provided so that it is necessary to apply a certain force to the connecting base 200 during the process of rotation for detachment, to avoid disengagement between the connecting base 200 and the fixing base 100 due to a misoperation, which, finally, may further improve stability of fit between the connecting base 200 and the fixing base 100.

Referring to FIG. 8 again, the example of the present disclosure discloses the connecting base 200 with a specific structure; and the disclosed connecting base 200 may include a lamp body mounting portion 230 and a side wall 250 extending along an outer periphery of the lamp body mounting portion 230 and perpendicular to the lamp body mounting portion 230. An edge of the side wall 250 protrudes inwardly to form a flange 251; and a recess formed by the flange 251 and the side wall 250 is the snap recess 210. The flange 251 is similar to a step formed on an inner surface of the side wall 250 and is configured to clamp an upper surface of the elastic buckle 110 extending horizontally, as shown in FIG. 9.

Referring to FIG. 3 to FIG. 4 again, the lamp body mounting portion 230 is a plate-like lamp body mounting portion; the plate-like lamp body mounting portion includes a plate-like base body 231 and an electrical connection port 232 provided on an outer surface of the plate-like base body 231. The electrical connection port 232 is configured to be electrically connected with the light source 600 of the ceiling lighting fixture. A second electrical connection portion 220 is provided on an inner surface of the plate-like base body 231 and is electrically connected with the electrical connection port 232.

Figure 7:
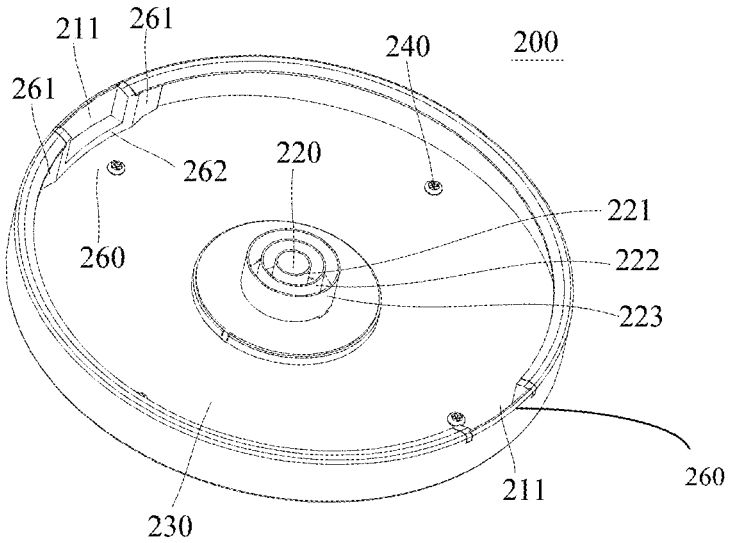
FIG. 7 is a schematic structural diagram of the connecting base from a viewing angle disclosed by an example of the present disclosure.
Figure 8:
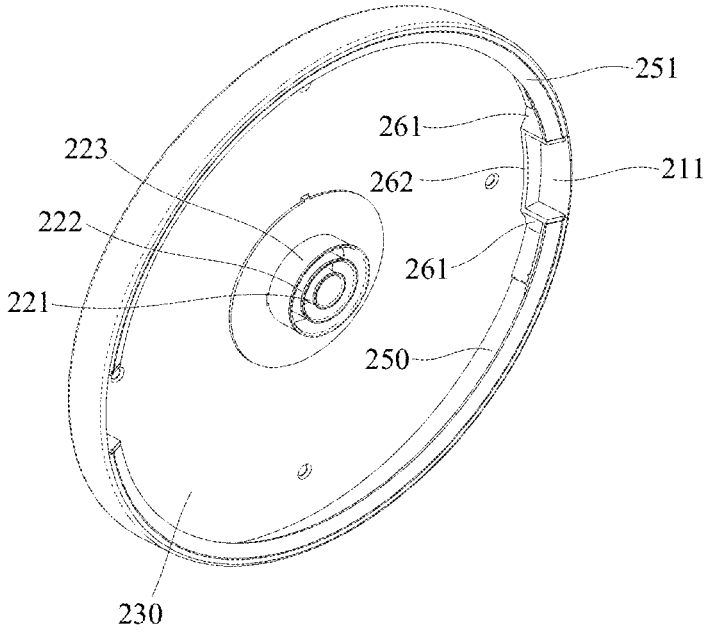
FIG. 8 is a schematic structural diagram of the connecting base from another viewing angle disclosed by an example of the present disclosure.
Figure 9:
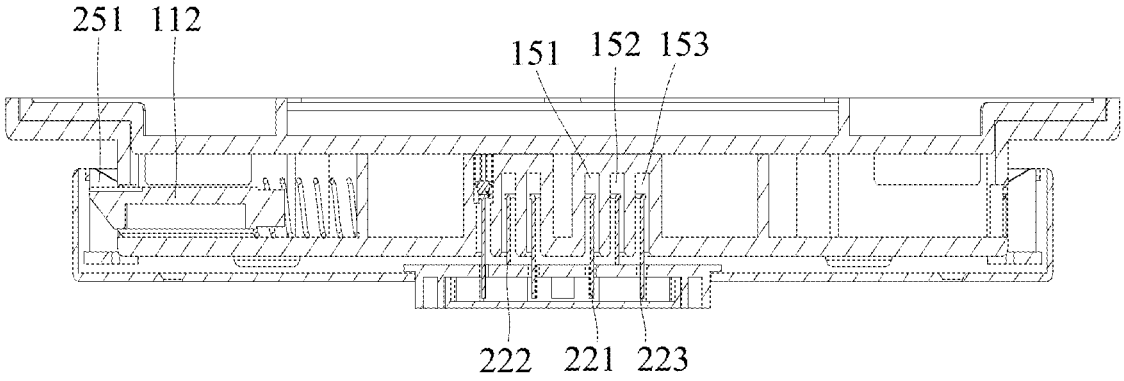
FIG. 9 is a schematic structural diagram of the fixing base and the connecting base in an assembled state disclosed by an example of the present disclosure.

In order to implement more compact assembling, referring to FIG. 7 to FIG. 9 again, the side wall 250 is an annular side wall adapted to a corresponding side face of the fixing base 100, and the annular side wall covers the corresponding side face of the fixing base 100.

There are a variety of manners of forming the avoidance notch 211: the avoidance notch may be directly on the side wall 250 of the lamp body mounting portion 230, or may be formed by a special component. Referring to FIG. 7 to FIG. 8 again, in the example of the present disclosure, the side wall 250 is an annular side wall; the side wall 250 is provided with at least two combining portions 260; the at least two combining portions 260 are discretely or separately distributed in a circumferential direction of the inner surface of the side wall 250; and the avoidance notch 211 may be provided on the combining portion 260.

Referring to FIG. 7 to FIG. 8 again, in a specific implementation, the combining portion 260 has a guide slope 261 connected with the inner surface of the side wall 250 at each side edge of the combining portion 260 and a main body portion 262 located between the two guide slopes 261; and the main body portion 262 protrudes out from the inner surface of the side wall 250, and is provided with the avoidance notch 211. In this case, the guide slope 261 functions to guide the elastic buckle 110, so that the elastic buckle 110 gradually moves from the guide slope 261 to the main body portion 262 during the process of rotating relative to the connecting base 200, and finally breaks away from the avoidance notch 211 on the main body portion 262.

In a specific implementation, the avoidance notch 211 may be a rectangular avoidance notch. The combining portion 260 may be a separate component, which may be detachably mounted on the inner surface of the side wall 250, or may also be integrated with the side wall 250, which will not be limited in the present disclosure.

The fixing base 100 is usually mounted on the indoor roof; usually, the fixing base 100 is provided with a connection hole, so as to be fixedly connected with the indoor roof by the user with an expansion bolt threading through the connection hole. As described above, in the process of mounting the installation assembly onto the indoor roof, the user may firstly mount the fixing base 100, then couple the power line to the fixing base 100, and finally mount the connecting base 200. Certainly, the user may also firstly couple the power line to the fixing base 100, then assemble the connecting base 200 to the fixing base 100, and finally mount the installation assembly integrally onto the mounting foundation (the indoor roof). In order to facilitate operations of the integral mounting manner, referring to FIG. 3 to FIG. 6, the fixing base 100 disclosed by the example of the present disclosure may include a foundation connection portion 130 and a connecting base connection portion 140; the elastic buckle 110 is provided on a side wall of the connecting base connection portion 140; an edge of the foundation connection portion 130 extends out from an edge of the connecting base connection portion 140; and the edge of the foundation connection portion 130 is provided with a connection hole 131 that may be fixedly connected with the mounting foundation (e.g., the indoor roof). In this case, the connection hole 131 is located on the edge that extends out from the connecting base connection portion 140, and the user's operation on the mounting foundation (e.g., the indoor roof) through the connection hole 131 is not affected by the connecting base 200.

Usually, during the process of mounting the fixing base 100, the user drives the expansion bolt into the mounting foundation through the connection hole 131, and the user may damage a corresponding position of the mounting foundation or have to avoid an electric wire in the corresponding position on the mounting foundation during the process of driving the expansion bolt; in order to ensure the above-described operation to be performed flexibly, in a preferred solution, the connection hole 131 may be a strip-shaped hole, for example, a waist-shaped hole. The user may adjust the position of the expansion bolt in a length direction of the connection hole to achieve the purpose of adjusting a connection position of the expansion bolt on the indoor roof.

Specifically, the foundation connection portion 130 may be a circular plate member. There may be a plurality of connection holes 131, and the plurality of connection holes 131 may implement fixed connection between the fixing base 100 and the mounting foundation (e.g., the indoor roof) in all directions. In order to balance a connection stress, Alternatively or additionally, the plurality of connection holes 131 may be evenly distributed along a circumferential direction of the edge of the foundation connection portion 130.

Certainly, the connection holes 131 having the shape and the number as described above may also be arranged on a fixing base 100 of other structures, which is not limited to the above-described fixing base 100 including the foundation connection portion 130 and the connecting base connection portion 140. For example, in the case where the fixing base 100 is a circular plate member, there may be a plurality of connection holes 131 that may be strip-shaped, and the plurality of strip-shaped holes may extend along a radial direction of the fixing base 100. Certainly, in a preferred solution, the plurality of strip-shaped holes may be evenly distributed along the circumferential direction of the edge of the foundation connection portion 130.

As described above, by mounting the connecting base 200 to the fixing base 100, electrical connection between the connecting base 200 and the fixing base 100 may be implemented. Referring to FIG. 3, FIG. 4, FIG. 5, FIG. 6 and FIG. 9, in a specific implementation, a first electrical connection portion 150 is provided on a side of the fixing base 100 that faces the connecting base 200; a second electrical connection portion 220 is provided on a side of the connecting base 200 that faces the fixing base 100; and the first electrical connection portion 150 is electrically connected with the second electrical connection portion 220. The connecting base 200 includes the lamp body mounting portion 230; the side of the lamp body mounting portion 230 that faces away from the fixing base 100 includes an electrical connection port 232; and the electrical connection port 232 is electrically connected with the second electrical connection portion 220. Specifically, the second electrical connection portion 220 is provided on an inner surface of the lamp body mounting portion 230 that faces the fixing base 100. After mounted to the lamp body mounting portion 230, the light source 600 may be electrically connected with the electrical connection port 232, and further implement electrical connection with the power line through electrical connection between the first electrical connection portion 150 and the second electrical connection portion 220.

As we know, the light source 600 has a variety of structures, for example, the lamp body is an ordinary bulb, or may also be an annular lamp tube, or may also be an LED light emitting module. In order to improve mounting stability of the light source 600, Alternatively or additionally, the connecting base 200 is provided with an auxiliary connecting member, the auxiliary connecting member is configured to assist in fixing the light source 600; and specifically, the auxiliary connecting member is provided on the lamp body mounting portion 230 of the connecting base 200. The auxiliary connecting member may be an elastic hoop or other structural member. Referring to FIG. 1, FIG. 2, FIG. 3, FIG. 4 or FIG. 7 again, a threaded connecting member 240 is provided on a side of the connecting base 200 that faces away from the fixing base 100; and the threaded connecting member 240 is configured to connect the light source 600, so as to assist in mounting the light source 600. Certainly, the auxiliary connecting member may also be a buckle, a threaded mouth, etc.; and both the buckle and the threaded mouth may be configured to connect the light source 600.

There are a variety of manners of connecting the first electrical connection portion 150 and the second electrical connection portion 220; usually, the first electrical connection portion 150 is plug-fitted with the second electrical connection portion 220 to achieve the purpose of electrical connection. Specifically, one of the first electrical connection portion 150 and the second electrical connection portion 220 is provided with a plug protrusion, and the other is provided with a plug recess. The plug protrusion is plug-fitted with the plug recess.

In a specific implementation, the first electrical connection portion 150 and the second electrical connection portion 220 are each formed by a plurality of concentrically distributed annular members, a plug recess is formed between adjacent two of the plurality of annular members of one of the first electrical connection portion 150 and the second electrical connection portion 220, and the plurality of annular members of the other of the first electrical connection portion 150 and the second electrical connection portion 220 are used as plug protrusions.

One of the first electrical connection portion 150 and the second electrical connection portion 220 may include at least two concentrically arranged annular electrical connection grooves, and the other includes at least two concentrically arranged annular conductive terminals; the at least two annular conductive terminals and the at least two annular electrical connection grooves are in one-to-one correspondence and plug-fitted with each other; and the at least two annular conductive terminals are electrically connected with conductive terminals of the at least two annular electrical connection grooves in one-to-one correspondence, to further implement electrical connection between the first electrical connection portion 150 and the second electrical connection portion 220.

Figure 4:
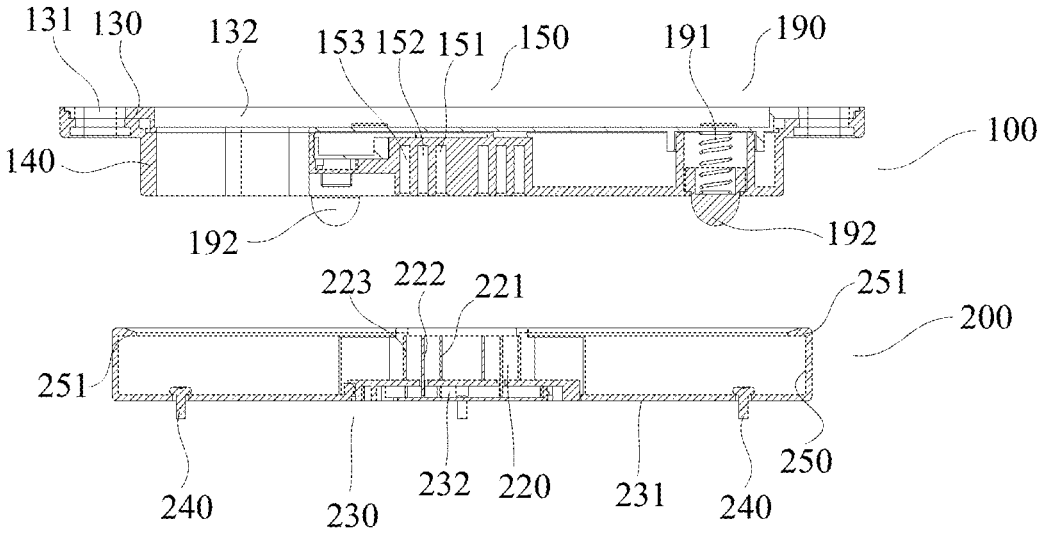
FIG. 4 illustrates a cross-sectional view of the connecting base in the unassembled state disclosed by an example of the present disclosure.

Referring to FIG. 4, FIG. 7 and FIG. 8, in a specific implementation, the second electrical connection portion 220 includes a first annular conductive terminal 221, a second annular conductive terminal 222, and a third annular conductive terminal 223 arranged concentrically and sequentially distributed from inside to outside; the first electrical connection portion 150 includes a first annular electrical connection groove 151, a second annular electrical connection groove 152, and a third annular electrical connection groove 153 arranged concentrically and sequentially distributed from inside to outside; the first annular conductive terminal 221, the second annular conductive terminal 222, and the third annular conductive terminal 223 are respectively accommodated in the first annular electrical connection groove 151, the second annular electrical connection groove 152, and the third annular electrical connection groove 153, and are respectively electrically connected with conductive terminals in the first annular electrical connection groove 151, the second annular electrical connection groove 152, and the third annular electrical connection groove 153, to finally implement electrical connection between the first electrical connection portion 150 and the second electrical connection portion 220. The first annular conductive terminal 221 and the first annular electrical connection groove 151, the second annular conductive terminal 222 and the second annular electrical connection groove 152, the third annular conductive terminal 223 and the third annular electrical connection groove 153 respectively form a positive electrical path, a negative electrical path, and a ground path.

Referring to FIG. 6, the fixing base 100 may be provided thereon with a power access port 160; and the power access port 160 is configured to connect the power line, for example, a mains cable. Certainly, the power access port 160 is electrically connected with the first electrical connection portion 150. In order to ensure safety of wiring, in a preferred solution, the fixing base 100 may further be provided thereon with a control switch group 170, and the control switch group 170 is configured to control switching on and off of supplying power from the power access port 160 to the first electrical connection portion 150. Alternatively or additionally, the control switch group 170 is provided between the power access port 160 and the first electrical connection portion 150, to increase a difficulty that the user simultaneously contacts the power access port 160 and the first electrical connection portion 150.

Referring to FIG. 6 again, usually, the power access port 160 includes a positive access port 161 and a negative access port 162; the control switch group 170 may include a first control switch 171 and a second control switch 172; the first control switch 171 and the second control switch 172 are respectively connected with the positive access port 161 and the negative access port 162, so as to respectively control switching on and off of a line where the positive access port 161 is located and a line where the negative access port 162 is located.

In a preferred solution, the power access port 160 may further include a ground access port 163; accordingly, the control switch group 170 may further include a third control switch 173; and the third control switch 173 is electronically and/or physically connected with the ground access port 163 to further control switching on and off of a line where the ground access port is located.

The three control switches are respectively connected with the positive access port 161, the negative access port 162, and the ground access port 163, and further control switching on and off of supplying power from the power lines connected with the positive access port 161, the negative access port 162 and the ground access port 163 to the first electrical connection portion 150. Certainly, in such case, there are three pairs of electrical connectors between the first electrical connection portion 150 and the second electrical connection portion 220, for example, three plug recesses and three annular members corresponding thereto.

In order to facilitate a wiring operation of the power line, as shown in FIG. 6, in a preferred solution, the fixing base 100 is provided with a threading hole 180 running through both ends thereof, and a side wall of the threading hole 180 is provided with the positive access port 161, the negative access port 162 and the ground access port 163. In the wiring process, the user may directly lead the power line from the threading hole 180 into a wiring cavity formed by the fixing base 100 and the connecting base 200. Meanwhile, since the threading hole 180 runs through from one end to the other end of the fixing base 100, after the fixing base 100 is mounted in place, the power line is directly threaded from an end of the fixing base 100 that is attached on the indoor roof through the threading hole 180, to prevent the user from further opening a threading hole in other part of the fixing base 100 or the connecting base 200 which renders poor appearance of the product. Specifically, there is an avoidance recess 132 on a surface of the foundation connection portion 130 that faces the mounting foundation (the indoor roof), and the avoidance recess 132 may accommodate the power line, so that the foundation connection portion 130 is more compactly fixed onto the mounting foundation.

Figure 5:
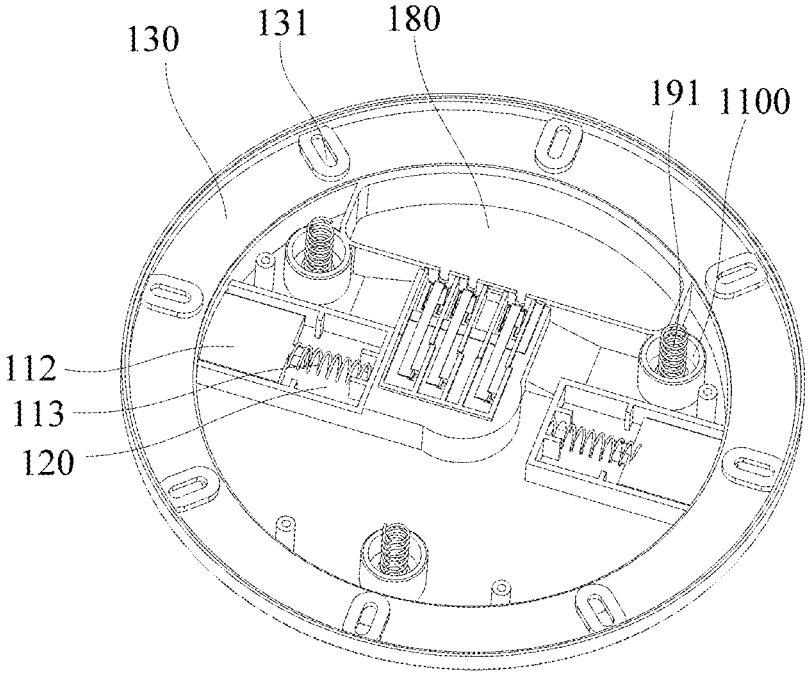
FIG. 5 is a schematic diagram of an internal structure of the fixing base disclosed by an example of the present disclosure.

As described above, during the mounting process, the user only needs to press the connecting base 200 toward the fixing base 100; in order to improve pressing feel and avoid pressing skewed and stuck, referring to FIG. 3, FIG. 4 and FIG. 5, in a preferred solution, an elastic tensioning portion 190 may be provided between the connecting base 200 and the fixing base 100; and the elastic tensioning portion 190 is configured to apply an elastic tension force to the connecting base 200. Under an action of the elastic tensioning portion 190, the user needs to overcome an elastic force of the elastic tensioning portion 190 when manipulating the connecting base 200, and further gradually press the connecting base 200 toward the fixing base 100.

The elastic tensioning portion 190 applies a tension force to the connecting base 200, so that snap-fitting between the elastic buckle 110 and the snap recess 210 is more stable, which improves mounting stability of the connecting base 200. Specifically, the elastic tensioning portion 190 may abut against the inner surface of the lamp body mounting portion 230 after the connecting base 200 is mounted in place, so as to achieve a purpose of applying the tension force. Certainly, arranging the elastic tensioning portion 190 will not affect the detaching of the connecting base 200, and the user only needs to apply a certain force to the connecting base 200 in a lifting direction and then rotate the connecting base 200, so as to implement detaching.

Alternatively or additionally, there may be a plurality of elastic tensioning portions 190; and the plurality of elastic tensioning portions 190 may be evenly arranged on a same circumference with a center of the fixing base 100 as a circle center. Specifically, there are three elastic tensioning portions 190, as shown in FIG. 1, FIG. 3, FIG. 4, FIG. 5 or FIG. 6.

In order to make extension and retraction of the elastic tensioning portion 190 more stable, the fixing base 100 may be provided with a second slide hole 1100, as shown in FIG. 5, the elastic tensioning portion 190 is provided in the second slide hole 1100, and the elastic tensioning portion 190 extends out from the second slide hole 1100 to get in elastic contact with the connecting base 200.

The elastic tensioning portion 190 may be an elastic structural member with a variety of structures. In a specific implementation, the elastic tensioning portion 190 may include a second elastic member 191 and a tensioning block 192; the second elastic member 191 may have an end fixed in the second slide hole 1100, and another end connected with the tensioning block 192. The tensioning block 192 is slidably provided in the second slide hole 1100, and has an end extending out from the second slide hole 1100 and being in contact with the connecting base 200. The second elastic member 191 may be an elastic member such as a spring or a rubber elastic block.

Based on the installation assemblies disclosed by the example of the present disclosure, an example of the present disclosure further discloses a ceiling lighting fixture, and the disclosed ceiling lighting fixture comprises the installation assembly as described in any one of the embodiments above.

In an actual application process, a light source, a fixing base 100 and a connecting base 200 may be sold separately, or some of them may be assembled together for selling. Usually, the connecting base 200 may be sold together with a light emitting module, and this combination is referred to as a ceiling lamp. In the present disclosure, the ceiling lighting fixture comprises the fixing base and the ceiling lamp. The user only needs to firstly mount the fixing base 100 (or a developer pre-mounted the fixing base 100 when delivering the house), and after the user purchases the ceiling lamp and returns home, the may complete mounting of the whole ceiling lighting fixture just by an upward press, which is very convenient, safe and reliable.

Figure 10:
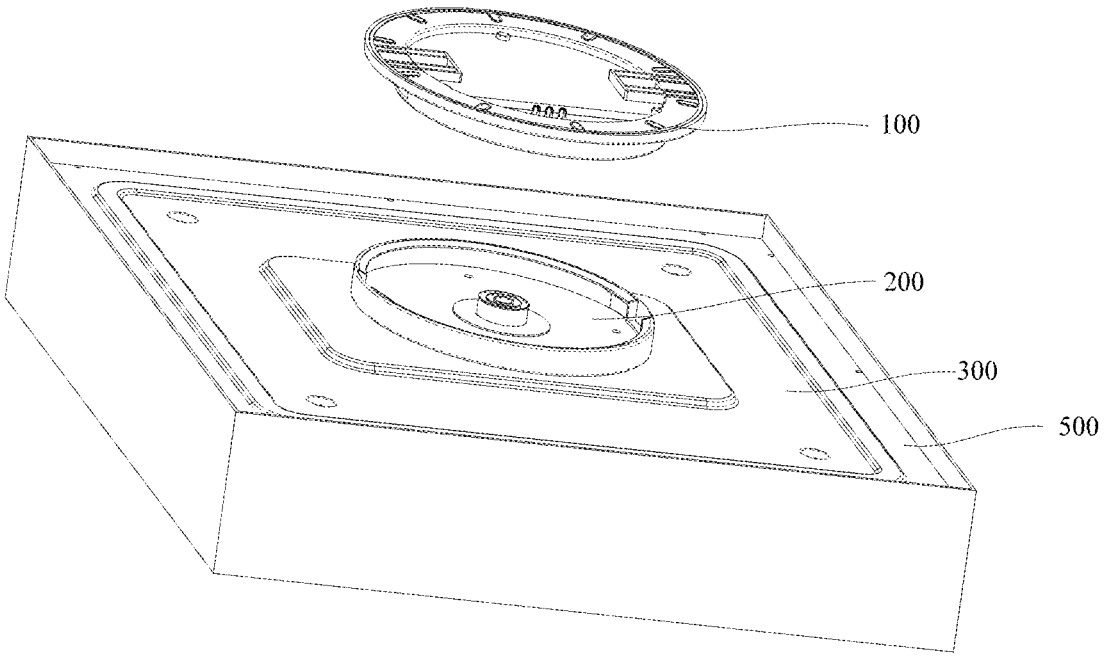
FIG. 10 is a schematic structural diagram of a ceiling lighting fixture disclosed by an example of the present disclosure.
Figure 11:
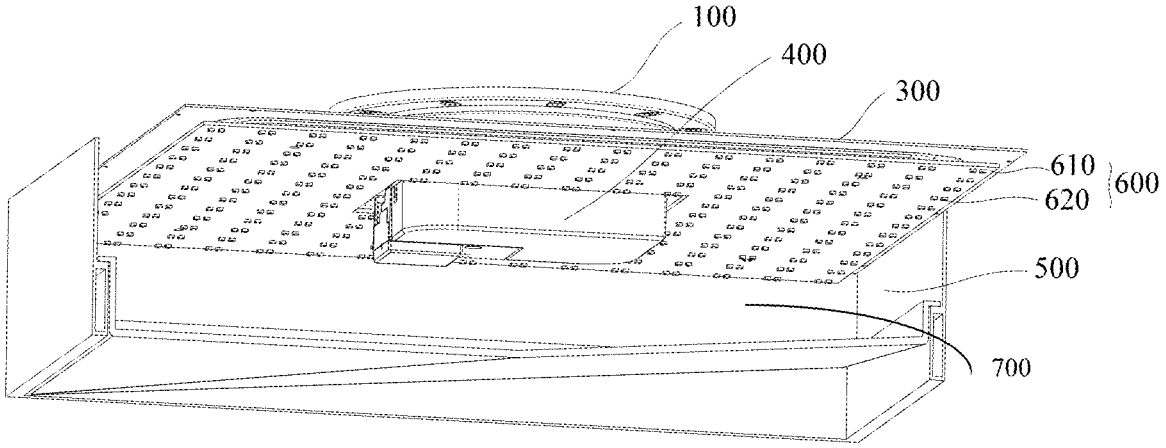
FIG. 11 is a partial schematic structural diagram of the ceiling lighting fixture disclosed by an example of the present disclosure.

Based on the above, an example of the present disclosure further discloses a ceiling lamp. Referring to FIG. 10 or FIG. 11, the disclosed ceiling lamp comprises a base plate 300, a driver 400, a light source 600, a connecting base 200, and a lamp cover 500 assembled on the base plate 300; the lamp cover 500 and the base plate 300 form a light mixing cavity 700; and the light source 600 and the driver 400 are both located in the light mixing cavity 700.

The light source 600 includes a substrate 610 and a light source 620; the light source 620 may usually be LED light bodies distributed in an array on the substrate 610. The driver 400 and the light source 620 are mounted on the substrate 610. Specifically, the driver 400 may be integrally formed with the substrate 610, or may also be assembled on the substrate 610 through an intermediate connecting member or a connection structure.

Referring to FIG. 3 to FIG. 8, the connecting base 200 includes a lamp body mounting portion 230 and a side wall 250 extending along an outer peripheral edge of the lamp body mounting portion 230 and perpendicular to the outer peripheral edge of the lamp body mounting portion 230; an edge of the side wall 250 protrudes inwardly to form a flange 251; the flange 251 and the side wall 250 constitute a snap recess 210; the snap recess 210 is configured to be snap-fitted with an elastic buckle 110 of a fixing base 100 of a ceiling lighting fixture; the lamp body mounting portion 230 includes a second electrical connection portion 220 and an electrical connection port 232 electrically connected with the second electrical connection portion 220; and the light source 600 and the driver 400 are electrically connected with the electrical connection port 232 of the connecting base 200. The second electrical connection portion 220 is configured to be electrically connected with a first electrical connection portion 150 of the fixing base 100.

Alternatively or additionally, in the above-mentioned installation assembly, the elastic buckle comprises a buckle body and a first elastic member; the first elastic member has one end provided on the fixing base or the connecting base and another end connected with the buckle body; and the buckle body has the guide slope.

Alternatively or additionally, in the above-mentioned installation assembly, the fixing base of the connecting base is provided with a first slide hole; the first elastic member is provided in the first slide hole; the buckle body is slidably provided in the first slide hole; and an end of the buckle body which is provided with the guide slope is capable of extending out from the first slide hole.

Alternatively or additionally, in the above-mentioned installation assembly, the fixing base is provided with the elastic buckle; the connecting base has a cover-like structure; and the snap recess is provided on an inner wall of the connecting base.

Alternatively or additionally, in the above-mentioned installation assembly, the fixing base comprises a foundation connection portion and a connecting base connection portion which are integrally formed; the elastic buckle is provided on a side wall of the connecting base connection portion; and an edge of the foundation connection portion protrudes out from an edge of the connecting base connection portion; and the edge of the foundation connection portion is provided with a connection hole which is capable of being fixedly connected with a mounting foundation.

Alternatively or additionally, in the above-mentioned installation assembly, the foundation connection portion is a circular plate member; there are a plurality of connection holes which are strip-shaped; and the plurality of strip-shaped holes extend along a radial direction of the foundation connection portion, or the plurality of strip-shaped holes are evenly distributed along a circumferential direction of the edge of the foundation connection portion.

Alternatively or additionally, in the above-mentioned installation assembly, a first electrical connection portion is provided on a side of the fixing base which faces the connecting base; a second electrical connection portion is provided on a side of the connecting base which faces the fixing base; the first electrical connection portion is electrically connected with the second electrical connection portion; the connecting base comprises a lamp body mounting portion; a side of the lamp body mounting portion which faces away from the fixing base comprises an electrical connection port; and the electrical connection port is electrically connected with the second electrical connection portion.

Alternatively or additionally, in the above-mentioned installation assembly, the connecting base comprises the lamp body mounting portion and a side wall vertically extending along an outer periphery of the lamp body mounting portion; an edge of the side wall protrudes inwardly to form a flange; and a recess formed by the flange and the side wall is the snap recess.

Alternatively or additionally, in the above-mentioned installation assembly, the lamp body mounting portion is a plate-like lamp body mounting portion; the plate-like lamp body mounting portion comprises a plate-like base body and the electrical connection port provided on an outer surface of the plate-like base body; and the second electrical connection portion is provided on an inner surface of the plate-like base body.

Alternatively or additionally, in the above-mentioned installation assembly, the side wall is an annular side wall adapted to a corresponding side face of the fixing base, and the annular side wall covers the corresponding side face of the fixing base.

Alternatively or additionally, in the above-mentioned installation assembly, the side wall is an annular side wall; the side wall is provided with at least two combining portions; the at least two combining portions are discretely distributed in a circumferential direction of an inner surface of the side wall; the combining portion have a guide slope connected with the inner surface of the side wall at each side edge of the combining portion and a main body portion located between two guide slopes; and the main body portion protrudes out from the inner surface of the side wall, and is provided with the avoidance notch.

Alternatively or additionally, in the above-mentioned installation assembly, the first electrical connection portion is plug-fitted with the second electrical connection portion; one of the first electrical connection portion and the second electrical connection portion is provided with a plug protrusion, and another one of the first electrical connection portion and the second electrical connection portion is provided with a plug recess; and the plug protrusion is plug-fitted with the plug recess.

Alternatively or additionally, in the above-mentioned installation assembly, one of the first electrical connection portion and the second electrical connection portion comprises at least two concentrically arranged annular electrical connection grooves, and another one of the first electrical connection portion and the second electrical connection portion comprises at least two concentrically arranged annular conductive terminals; the at least two annular conductive terminals and the at least two annular electrical connection grooves are in one-to-one correspondence and plug-fitted with each other; and the at least two annular conductive terminals are electrically connected with conductive terminals in the at least two annular electrical connection grooves in one-to-one correspondence.

Alternatively or additionally, in the above-mentioned installation assembly, the second electrical connection portion comprises a first annular conductive terminal, a second annular conductive terminal, and a third annular conductive terminal arranged concentrically and sequentially distributed from inside to outside; the first electrical connection portion comprises a first annular electrical connection groove, a second annular electrical connection groove, and a third annular electrical connection groove arranged concentrically and sequentially distributed from inside to outside; and the first annular conductive terminal, the second annular conductive terminal, and the third annular conductive terminal are respectively accommodated in the first annular electrical connection groove, the second annular electrical connection groove, and the third annular electrical connection groove, and are respectively electrically connected with conductive terminals in the first annular electrical connection groove, the second annular electrical connection groove, and the third annular electrical connection groove.

Alternatively or additionally, in the above-mentioned installation assembly, the fixing base is provided with a power access port; the power access port is configured to connect a power line, and to be electrically connected with the first electrical connection portion; and the control switch group is configured to control switching on and off of supplying power from the power access port to the first electrical connection portion.

Alternatively or additionally, in the above-mentioned installation assembly, the power access port comprises a positive access port and a negative access port; the control switch group comprises a first control switch and a second control switch; and the first control switch and the second control switch are respectively connected with the positive access port and the negative access port.

Alternatively or additionally, in the above-mentioned installation assembly, the power access port further comprises a ground access port; the control switch group further comprises a third control switch; and the third control switch is electronically and/or physically connected with the ground access port.

Alternatively or additionally, in the above-mentioned installation assembly, the fixing base is provided with a threading hole running through both ends of the fixing base; and a side wall of the threading hole is provided with the positive access port, the negative access port and the ground access port.

Alternatively or additionally, in the above-mentioned installation assembly, an elastic tensioning portion is provided between the connecting base and the fixing base; and the elastic tensioning portion is configured to apply an elastic tension force to the connecting base.

Alternatively or additionally, in the above-mentioned installation assembly, there are a plurality of elastic tensioning portions; and the plurality of elastic tensioning portions are evenly arranged on a same circumference with a center of the fixing base as a circle center.

Alternatively or additionally, in the above-mentioned installation assembly, the fixing base is provided with a second slide hole; the elastic tensioning portion comprises a second elastic member and a tensioning block; the second elastic member has an end fixed in the second slide hole, and another end connected with the tensioning block; and the tensioning block is slidably provided in the second slide hole, and has an end extending out from the second slide hole and being in contact with the connecting base.

Alternatively or additionally, in the above-mentioned installation assembly, a threaded connecting member, a threaded mouth, or a buckle is provided on a side of the connecting base that faces away from the fixing base; and the threaded connecting member, the threaded mouth, and the buckle is configured to connect a lamp body.

Description of the corresponding parts above may be referred to for some components of the above-described ceiling lamp, and no details will be repeated here.

Herein, the technical features in the preferred solutions may be combined to form a solution as long as there is no contradiction, and these solutions are within the scope of the present disclosure.

Herein, the individual preferred solutions are only focused on describing differences with respect to other preferred solutions, the preferred solutions may be arbitrarily combined as long as there is no conflict, the embodiments formed by combination are also within the scope disclosed by this specification, and the embodiments formed by combination will not be described separately herein in consideration of text conciseness.

The above are only embodiments of the present disclosure, and not intended to limit the present disclosure. For those skilled in the art, various changes and modifications may be made to the present disclosure. Any modifications, equivalent alternations and improvements without departing from the spirit and principle of the present disclosure shall be included within the protection scope thereof.

The invention claimed is:

1. An installation assembly of a ceiling lighting fixture, the installation assembly comprising:

a fixing base and a connecting base detachably connected with the fixing base;

wherein one of the fixing base and the connecting base is provided with a snap recess, and a remaining one of the fixing base and the connecting base is provided with an elastic buckle capable of being snap-fitted with the snap recess;

wherein the elastic buckle has a guide slope, the elastic buckle is capable of being compressed as the connecting base moves toward the fixing base, and being introduced into the snap recess through the guide slope; and wherein the elastic buckle is rotationally fitted with the snap recess, and the snap recess is provided with an avoidance notch for the elastic buckle to be detached.

2. The installation assembly according to claim 1, wherein the elastic buckle comprises a buckle body and a first elastic member;

wherein the first elastic member comprises one end provided on the fixing base or the connecting base and another end connected with the buckle body; and wherein the buckle body comprises the guide slope.

3. The installation assembly according to claim 2, wherein:

the fixing base or the connecting base is provided with a first slide hole;

the first elastic member is provided in the first slide hole;

the buckle body is slidably provided in the first slide hole; and an end of the buckle body which is provided with the guide slope is capable of extending out from the first slide hole.

4. The installation assembly according to claim 1, wherein:

the fixing base is provided with the elastic buckle;

the connecting base has a cover-like structure; and the snap recess is provided on an inner wall of the connecting base.

5. The installation assembly according to claim 4, wherein:

the fixing base comprises a foundation connection portion and a connecting base connection portion which are integrally formed;

the elastic buckle is provided on a side wall of the connecting base connection portion; and an edge of the foundation connection portion protrudes out from an edge of the connecting base connection portion; and the edge of the foundation connection portion is provided with a connection hole which is capable of being fixedly connected with a mounting foundation.

6. The installation assembly according to claim 5, further comprising: a plurality of strip-shaped holes, wherein wherein the foundation connection portion is a circular plate member; and wherein the plurality of strip-shaped holes extend along a radial direction of the foundation connection portion, or the plurality of strip-shaped holes are evenly distributed along a circumferential direction of the edge of the foundation connection portion.

7. The installation assembly according to claim 1, wherein:

a first electrical connection portion is provided on a side of the fixing base which faces the connecting base;

a second electrical connection portion is provided on a side of the connecting base which faces the fixing base;

the first electrical connection portion is electrically connected with the second electrical connection portion;

the connecting base comprises a lamp body mounting portion;

a side of the lamp body mounting portion which faces away from the fixing base comprises an electrical connection port; and the electrical connection port is electrically connected with the second electrical connection portion.

8. The installation assembly according to claim 7, wherein:

the connecting base comprises the lamp body mounting portion and a side wall vertically extending along an outer periphery of the lamp body mounting portion;

an edge of the side wall protrudes inwardly to form a flange; and a recess formed by the flange and the side wall is the snap recess.

9. The installation assembly according to claim 8, wherein:

the lamp body mounting portion is a plate-like lamp body mounting portion;

the plate-like lamp body mounting portion comprises a plate-like base body and the electrical connection port provided on an outer surface of the plate-like base body; and the second electrical connection portion is provided on an inner surface of the plate-like base body.

10. The installation assembly according to claim 8, wherein the side wall is an annular side wall adapted to a corresponding side face of the fixing base, and the annular side wall covers the corresponding side face of the fixing base.

11. The installation assembly according to claim 8, wherein:

the side wall is an annular side wall;

the side wall comprises at least two combining portions;

the at least two combining portions are separately distributed in a circumferential direction of an inner surface of the side wall;

at least one combining portion has a guide slope connected with the inner surface of the side wall at each side edge of the at least one combining portion and a main body portion located between two guide slopes; and the main body portion protrudes out from the inner surface of the side wall, and is provided with the avoidance notch.

12. The installation assembly according to claim 7, wherein the first electrical connection portion is plug-fitted with the second electrical connection portion; one of the first electrical connection portion and the second electrical connection portion is provided with a plug protrusion, and another one of the first electrical connection portion and the second electrical connection portion is provided with a plug recess; and the plug protrusion is plug-fitted with the plug recess.

13. The installation assembly according to claim 12, wherein:

one of the first electrical connection portion and the second electrical connection portion comprises at least two concentrically arranged annular electrical connection grooves, and another one of the first electrical connection portion and the second electrical connection portion comprises at least two concentrically arranged annular conductive terminals;

the at least two annular conductive terminals and the at least two annular electrical connection grooves are in one-to-one correspondence and plug-fitted with each other; and the at least two annular conductive terminals are electrically connected with conductive terminals in the at least two annular electrical connection grooves in one-to-one correspondence.

14. The installation assembly according to claim 13, wherein the second electrical connection portion comprises a first annular conductive terminal, a second annular conductive terminal, and a third annular conductive terminal arranged concentrically and sequentially distributed from inside to outside;

the first electrical connection portion comprises a first annular electrical connection groove, a second annular electrical connection groove, and a third annular electrical connection groove arranged concentrically and sequentially distributed from inside to outside; and the first annular conductive terminal, the second annular conductive terminal, and the third annular conductive terminal are respectively accommodated in the first annular electrical connection groove, the second annular electrical connection groove, and the third annular electrical connection groove, and are respectively electrically connected with conductive terminals in the first annular electrical connection groove, the second annular electrical connection groove, and the third annular electrical connection groove.

15. The installation assembly according to claim 12, wherein:

the fixing base is provided with a power access port and a control switch group;

the power access port is configured to connect a power line, and to be electrically connected with the first electrical connection portion; and the control switch group is configured to control switching on and off of supplying power from the power access port to the first electrical connection portion.

16. The installation assembly according to claim 15, wherein:

the power access port comprises a positive access port and a negative access port;

the control switch group comprises a first control switch and a second control switch; and the first control switch and the second control switch are respectively connected with the positive access port and the negative access port.

17. The installation assembly according to claim 16, wherein:

the power access port further comprises a ground access port;

the control switch group further comprises a third control switch; and the third control switch is electronically connected with the ground access port.

18. The installation assembly according to claim 17, wherein:

the fixing base is provided with a threading hole running through both ends of the fixing base; and a side wall of the threading hole is provided with the positive access port, the negative access port and the ground access port.

19. The installation assembly according to claim 1, wherein an elastic tensioning portion is provided between the connecting base and the fixing base; and the elastic tensioning portion is configured to apply an elastic tension force to the connecting base.

20. A ceiling lamp, comprising a base plate, a light source, a driver, a connecting base, and a lamp cover assembled on the base plate; the lamp cover and the base plate forming a light mixing cavity; the light source comprising a substrate and a light source; the driver and the light source being mounted on the substrate and located in the light mixing cavity; the connecting base comprising a lamp body mounting portion and a side wall extending along an outer peripheral edge of the lamp body mounting portion and perpendicular to the outer peripheral edge of the lamp body mounting portion; an edge of the side wall protruding inwardly to form a flange; the flange and the side wall forming a snap recess; the snap recess being configured to be snap-fitted with an elastic buckle of a fixing base of a ceiling lighting fixture; the lamp body mounting portion comprising a second electrical connection portion and an electrical connection port electrically connected with the second electrical connection portion; the driver and the light source being electrically connected with the electrical connection port; and the second electrical connection portion being configured to be electrically connected with a first electrical connection portion of the fixing base.

* * * * *